United States Patent [19]

Policht

[11] Patent Number: 5,040,216

[45] Date of Patent: Aug. 13, 1991

[54] PHOTO ALBUM ASSEMBLY AND PACKAGE

[75] Inventor: Stanislaw A. Policht, Closter, N.J.

[73] Assignee: Qualex, Inc., Durham, N.C.

[21] Appl. No.: 469,399

[22] Filed: Jan. 24, 1990

[51] Int. Cl.[5] ..... B42F 3/00; B42F 13/06; B42F 13/10

[52] U.S. Cl. ..... 281/46; 40/357; 281/38; 281/21.001; 281/15.001; 281/22; 402/79; 402/501

[58] Field of Search ..... 40/530, 537; 281/15.1, 281/21.1, 22, 29, 31, 45, 46, 47, 48, 51, 38; 402/79, 80 R, 501

[56] References Cited

U.S. PATENT DOCUMENTS

| | | | |
|---|---|---|---|
| 681,118 | 8/1901 | Henkle | 402/501 |
| 1,075,623 | 10/1913 | Benjamin et al. | 402/501 |
| 1,336,438 | 4/1920 | Kraetsch | 281/45 |
| 1,432,453 | 10/1922 | Finger | 402/501 |
| 1,710,331 | 4/1929 | Aberle | 402/501 |
| 2,981,259 | 4/1961 | Smith et al. | 281/45 |
| 3,116,738 | 1/1964 | Wentges | 402/501 |
| 3,797,146 | 3/1974 | Holes | 402/79 X |
| 3,870,223 | 3/1975 | Wyant | 281/15.1 |
| 4,530,176 | 7/1985 | Rejwan | 40/359 |
| 4,601,489 | 7/1986 | Stancato | 281/21 R |
| 4,795,287 | 1/1989 | Friedman | 402/79 |
| 4,997,206 | 3/1991 | Hong | 281/15.1 |

*Primary Examiner*—Paul A. Bell
*Attorney, Agent, or Firm*—Kinzer, Plyer, Dorn, McEachran & Jambor

[57] ABSTRACT

A photo album assembly has a book-like cover formed of two sheets of plastic, edge sealed to afford front and rear cover panels hinged to a spine panel. In one embodiment each cover panel includes a pocket that receives a paperboard stiffener; in another embodiment stiffer material is used for the inner cover panel sheets. A pair of rectangular retainers are mounted on one cover panel, adjacent opposite ends of the spine panel; a plurality of long, thin binder members are mounted between the retainers, each binder member having slots at both ends that engage the retainers for this purposes. For each binder member there is a flexible hinge tape, having two adhesive-coated strips separated by a non-adhesive hinge strip; one adhesive strip mounts the hinge tape along the edge of the binder member, and the other adhesive strip mounts a photo on the binder member. Alternatively, the binder members may be of unitary construction, with just one adhesive strip for photo mounting. The album is usually shipped to the customer, complete with photographs, in a package assembled in an automated photo processing plant.

17 Claims, 3 Drawing Sheets

PHOTO ALBUM ASSEMBLY AND PACKAGE

BACKGROUND OF THE INVENTION

Most photo albums utilize a construction like a book or a loose-leaf binder, with pages of paper on which the photographs are mounted by various means, such as adhesive, transparent film envelopes affixed to the pages, corner mounts on the pages, etc. In any of these albums, the pages themselves add materially to the bulk and weight of the album; the album is even more excessively "overweight" if transparent envelopes are employed. Cost is frequently more than desired, particularly for albums that are fully assembled prior to sale.

An ideal photo album is one that has minimal size and weight in relation to the number of photographic prints that can be stored in the album. It should be inexpensive to manufacture and assemble and should allow the option, at least, of appreciable assembly by the ultimate purchaser/user; that is, the photo album should be readily adaptable to sale in kit form. The photo album should afford maximum versatility in use, as to print sizes and shapes, either by plural album sizes or by simple and effective adaptation of one album to storage of photos of various sizes. Ready visibility of the stored photos is a requisite feature; the album should expose both sides of the print so that data identifying its contents and history (who, where, what, when) if applied to the back of the photo, is immediately accessible. The photo album should not be dependent upon retained elasticity of any of its elements; most inexpensive elastomer members lose their elasticity as a natural process of aging. Realization of all of these attributes in one album, using conventional constructions, has not previously been effected.

SUMMARY OF THE INVENTION

The principal object of the invention, therefore, is to provide a new and improved photo package that is simple and inexpensive to manufacture, that can be sold assembled or in kit form, that is of minimum size and weight for a given storage capacity, that may be versatile in accommodating photos of various sizes, that shows both sides of each photo, and that mounts all photographs, uniquely, within a book-like cover.

Accordingly, the invention relates to a photo album assembly comprising a book-like cover including a front cover panel a spine panel, and a rear cover panel, the front and rear cover panels being hinged to opposite sides of the spine panel. There are a pair of retainers and means for mounting the retainers in the cover adjacent opposite ends of the spine panel and immediately adjacent to one of the cover panels with the retainers facing each other but separated by a retainer spacing R less than the height of the spine panel. The assembly includes a plurality of thin, elongated binder members each of length L, height H, and thickness T, so that $$L >> H >> T$$

with L somewhat larger than R; each binder member has two slots, one at each end of the binder member, for engaging the two retainers to mount the binder member in the album cover parallel to the spine panel, each slot having an overall length S at least equal to one-half the difference between L and R. There are N flexible hinge strips each extending along the one edge of a binder member opposite the spine panel, an adhesive photo mounting strip, parallel to and projecting away from each hinge strip, for mounting a photo in the album.

DESCRIPTION OF THE PREFERRED EMBODIMENTS

Figure 1:
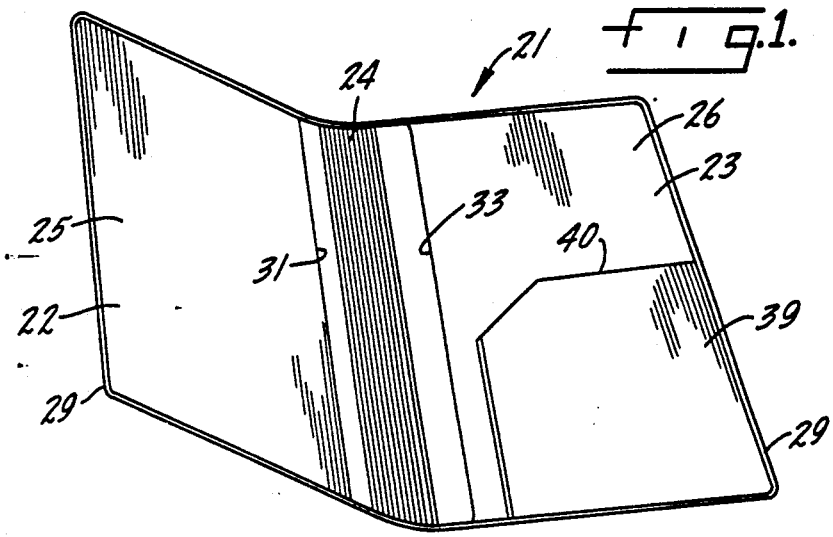
FIG. 1 is a perspective view of an open cover for a photo album assembly according to one embodiment of the invention.
Figure 3:
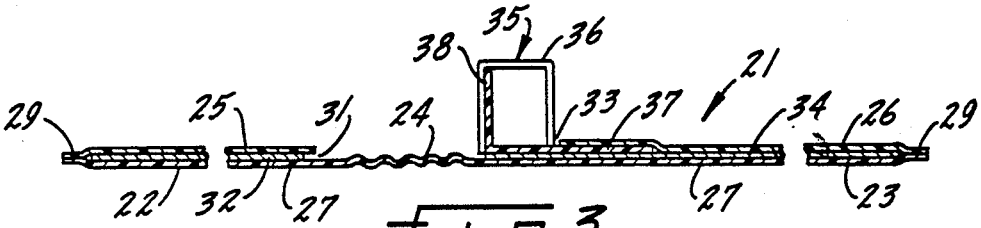
FIG. 3 is a sectional view of the cover of FIG. 1 assembled with the retainer and stiffener member of FIG. 2 and an additional panel stiffener.

FIG. 1 illustrates a cover 21 for a photo album assembly constructed in accordance with one embodiment of the present invention. The book-like album cover 21 includes a front cover panel 22 and a rear panel cover 23 each hingedly connected to a spine panel 24. Cover 21 is formed from three plastic sheets 25, 26 and 27 as best shown in FIG. 3. Sheet 27 constitutes the outside of cover 21, and sheets 25 and 26 form the inner surfaces of most of the cover. The two resin sheets for each of the panels 22 and 23 are sealed together around the peripheries of the panels as indicated by seals 29 in FIGS. 1 and 3. The spine panel 24 functions as a hinge for front panel 22 and rear panel 23.

The plastic sheets 25 and 26 that afford the inner surfaces of front cover panel 22 and rear cover panel 23 each have an unsealed edge that extends from the top to the bottom of the panel, closely adjacent to spine 24; these are the edges 31 and 33. A front panel stiffener 32 is inserted through opening 31 into the space between plastic sheets 25 and 27, as shown in FIG. 3. Member 32, which stiffens the front cover panel 22 of album cover 21, may be formed as a simple rectangular sheet of paperboard.

A similar rectangular stiffener sheet 34 is provided for the rear cover panel 23 of album cover 21 and is inserted into the space between plastic sheets 27 and 26 through the open edge 33 (FIGS. 1 and 3). As with member 32, stiffener 34 may be formed of ordinary cardboard. This rear panel stiffener 34, has a retainer means 35 mounted on it (FIGS. 2 and 3) to serve as means for retaining a plurality of photographs in the album as described hereinafter. Retainer means 35 includes two hollow rectangular plastic retainers 36 mounted at opposite ends of a plastic angle member including a mounting strip 37 that is secured to stiffener 34. A retainer brace strip 38 extends between and is affixed to retainers 36; strip 38 is joined along one edge to mounting strip 37.

Album cover 21 further includes a small storage pocket 39 for photo negatives; pocket 39 is sealed into one corner of the inner plastic sheet 26 in the rear panel 23 of the book-like cover. The top edge 40 of the negative storage pocket 29 is left open for ready insertion of negatives into the pocket.

Figure 4:
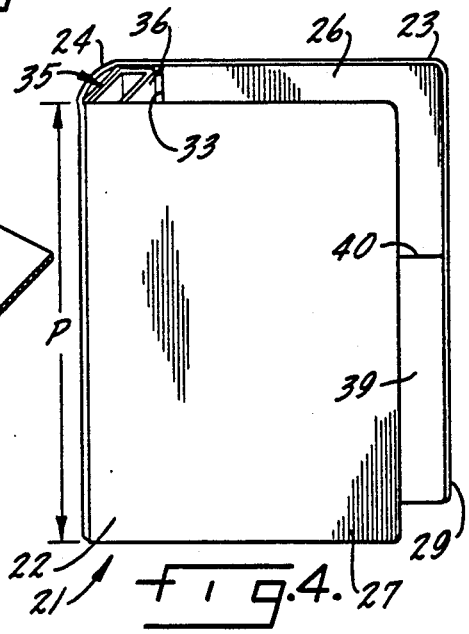
FIG. 4 is a perspective elevation view of the assembled cover.

Album cover 21, fully assembled, as shown in FIG. 4, has a maximum dimension P parallel to its spine panel 24. The corresponding dimension of the cover stiffeners, such as stiffener 34 (FIG. 2), is slightly smaller than the external cover dimension P so that the reinforcements will fit into the pockets in cover panels 22 and 23 through the open edges 31 and 32. Of course, the maximum dimension R of mounting sheet 27 (FIG. 2) is less than the overall height of stiffener 34 in the same direction, in order to leave room for retainers 36.

Figure 5:
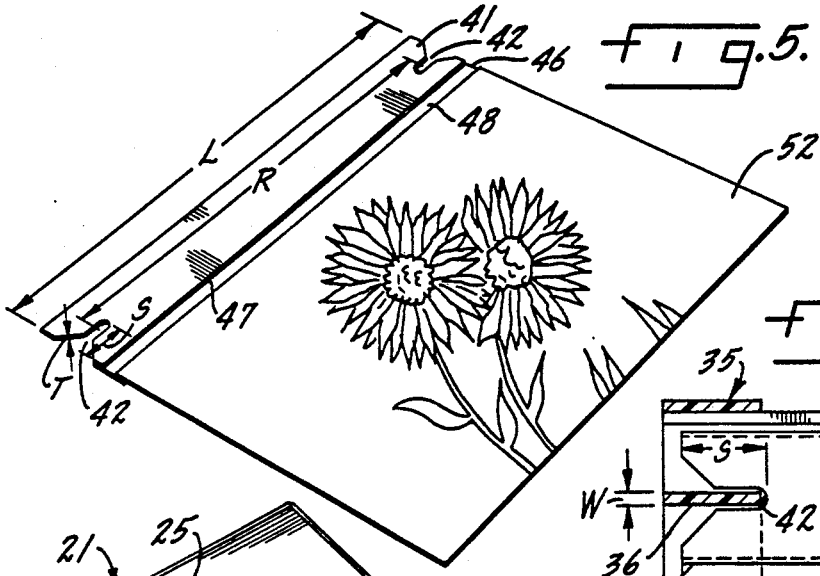
FIG. 5 is a perspective view of a binder member, a hinge tape, and a photograph, assembled ready to mount in the cover of FIGS. 3 and 4.
Figure 6:
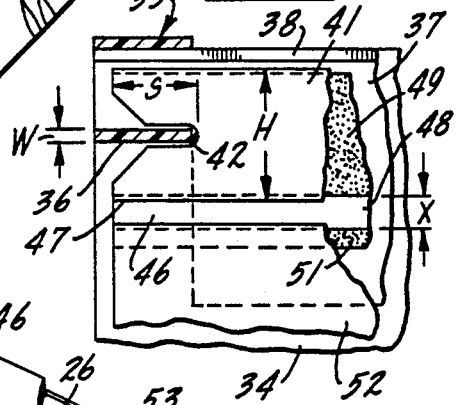
FIG. 6 is a detail plan view of one corner of the photo binder assembly of FIG. 5 as mounted in the cover of FIGS. 3 and 4.

FIGS. 5 and 6 illustrate one embodiment of a binder member construction that may be utilized to mount a photographic print 52 in the cover 21 described above in conjunction with FIGS. 1–4. FIGS. 5 and 6 show one binder member 41; in a complete photo album assembly there would be a plurality N of these binder members and a corresponding plurality N of all other members associated with them. Each binder member 41 has a length L that is somewhat longer than the dimension R, the spacing between retainer members 36; see FIGS. 2 and 5. Each binder member 41 has two Y-shaped slots 42 at its opposite ends, and each of these slots has a working depth S. The width of the leg portion of each slot 42 should be larger than the width W of the related retainers 36 so that the binder member mounts readily on the retainers; see FIG. 6. The overall height H of each binder strip 41 is much smaller than its length L (FIG. 5). The thickness T of each binder strip 41 is very much smaller than its height H, so that each binder member 41 is of thin, bendable, strip-like configuration.

Figure 7:
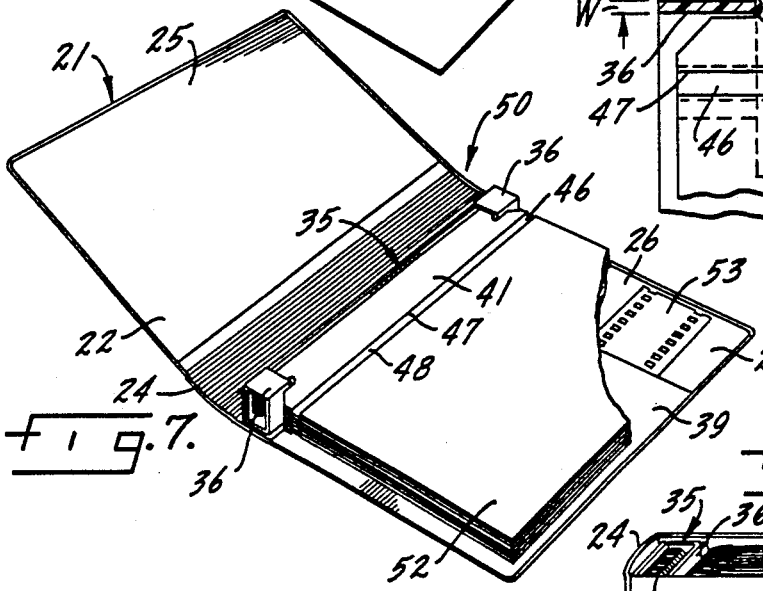
FIGS. 7 and 8 are perspective views of a photo album assembled with the components of FIGS. 1-6.

The album assembly of the present invention also includes a plurality of flexible hinge tapes 46, one hinge tape 46 for each binder member 41 (see FIGS. 5–7). Each hinge tape 46 is mounted on its binder member 41, extending along and projecting from one edge 47 of the binder member. In the embodiment of FIGS. 5 and 6, hinge tape 46 is secured to its binder member 41 by an adhesive strip 49 deposited along the edge of the hinge tape. Each hinge tape 46 also has a central, non-adhesive hinge strip 48 of height X and an additional adhesive strip 51 that extends along the edge of hinge tape 46 opposite the first adhesive strip 49. The second adhesive strip 51 on hinge tape 46 is used to mount a photographic print 52 on each binder member 41.

Figure 8:
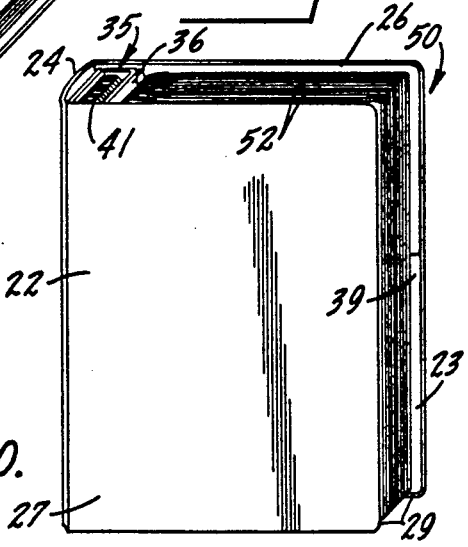

FIG. 7 illustrates a full assembled photo album 50 partially filled with photographs; FIG. 8 shows the photo album 50 completely filled with photographs 52. Each of the individual photographs 52 has been mounted on one of the hinge tapes 46 by engagement with the outermost adhesive strip 51 on the hinge tape, in the manner illustrated in each of FIGS. 5 and 6. Each hinge tape 46, in turn, is mounted on one of the binder members 41 by means of the innermost adhesive strip 49, in the manner illustrated in FIG. 6, with the hinge strip 48 of tape 46 immediately adjacent its binder member 41 (FIG. 7) so that each photograph 52 can be easily folded to an open, visible position Binder members 41 are all mounted on the two retainers 36 in cover 21; the mounting of the binder members on the retainers is best illustrated in FIGS. 6 and 7. Negatives 53 for the photos 52 may be stored in pocket 39 as shown in FIG. 7.

Album 50 may be sold in kit form or in assembled condition. In all forms, cover 21 (FIG. 1) should be fabricated in complete, usable form. The cover panel reinforcements 32 and 34 can be inserted into cover 21 before sale or may be left separate with instructions for the user/purchaser to insert them through edge openings 31 and 33 in the inside of the cover panels. Retaining means 35, the combination of mounting member 37, stiffener strip 38, and retainers 36, should be completed in final form and is preferably affixed to stiffener sheet 34, adhesively or otherwise, prior to sale.

Binder members 41 on the other hand, could be sold separately or might be mounted in the album prior to sale. Hinge tapes 46 could also be kept separate, with instructions for use by the purchaser. Alternatively, each of the hinge tapes may be mounted on its associated binder member 41 as shown in FIGS. 5 and 6. In either event, any exposed adhesive, whether only strip 51 or both of the strips 49 and 51, preferably should be covered by release tape, regardless of whether the album is sold fully assembled or as a kit.

Photo album assembly 50 is simple and inexpensive to manufacture. The materials are all quite inexpensive (plastic, paper, adhesive, and possibly some fabric). There are no metal parts and no complex fabrication procedures. Indeed, much of the assembly work can be left to the ultimate user/purchaser in those instances in which the album is sold as a kit. But album assembly 50 does provide maximum storage capacity for the overall size of the album. A variety of print sizes could be accommodated in the album. FIG. 5 shows a photographic print matched to an album of given size, as would be done for any instance in which the photographic prints and album are sold as a complete package. Smaller prints could be mounted in the same way, trimming off any excess length of the outer adhesive portion 51 of hinge tape 36.

Album 50 facilitates storage, presentation, and cataloging of photographic prints in a convenient and elegant manner. The photographs may be organized in any sequence and may be easily re-arranged or removed from the album at any time. Both sides of each photograph are readily accessible for viewing so that any identification data on the back of a print may be examined at will.

In order to afford a complete illustration of a practical construction for assembly 50, specific parameters are set forth hereinafter. It should be understood that this information is provided solely by way of illustration and not as a limitation on the invention.

Dimensions

| Dimensions | | |
|---|---|---|
| R (FIG. 2) | 5.437 inches, | 13.81 cm. |
| P (FIG. 4) | 6.375 inches, | 16.19 cm. |
| L (FIG. 5) | 5.875 inches, | 14.92 cm. |
| H (FIGS. 6, 9) | 0.5 inch, | 1.27 cm. |
| T (FIGS. 5, 10) | 0.01 inch, | 0.025 cm. |
| X (FIG. 6) | 0.28 inch, | 0.71 cm. |
| S (FIGS. 5, 6) | 0.25 inch, | 0.635 cm. |

-continued

| Dimensions | | |
|---|---|---|
| W (FIG. 6) | 0.04 inch, | 0.102 cm. |
| Y (FIG. 9) | 0.906 inch, | 2.44 cm. |

Materials

Sheets 25 and 27, vinyl sheet of 0.013 inch (gauge) thickness, preferably embossed and pigmented for a leather-like appearance.

Retainers 36, polyvinyl chloride resin, transparent or pigmented. The same material may be used for members 37 and 38.

Adhesive strips 49, 51 and 81, natural rubber.

Binder members 41, paper.

Binder members 71, polyvinyl chloride resin.

Hinge tape 46, polyester resin.

Figure 9:
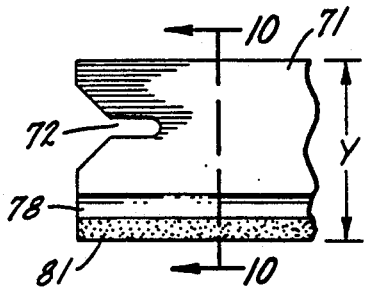
FIG. 9 is a detail view of another embodiment of a photo binder member usable in an album according to the invention.
Figure 10:
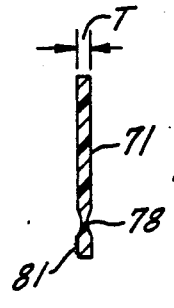
FIG. 10 is a sectional view taken approximately as indicated by line 10—10 in FIG. 9.

FIGS. 9 and 10 illustrate an alternative construction for a combined, integrated binder member and hinge tape. The binder member 71 shown in FIGS. 9 and 10 is preferably formed from sheet stock having a height H, a maximum thickness T, and a length L suited to the album in which the binder member is to be used. Binder member 71 has slots at its opposite ends; only one of these slots 72 is shown. One edge portion of binder member 71 is thinner than T and affords a flexible hinge member 78, like a strip of tape; on the outer edge of the hinge tape 78 there is an adhesive coating constituting a photo mounting strip 81.

In use, binder member 71 may be substituted directly for the combination of binder member 41 and hinge tape 46. Indeed, the two may be intermingled in the same photo album, as long as the cover is of a size to fit them both. The uses and advantages of a complete photo album assembly, using binder members 71, is the same as described above.

Figure 2:
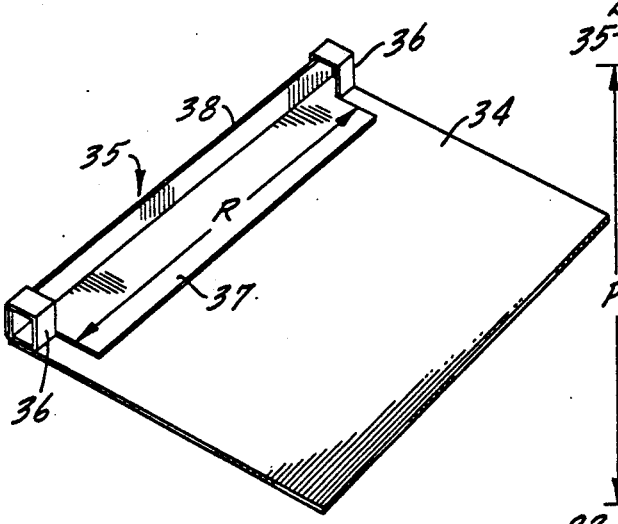
FIG. 2 is a perspective view of a retainer and stiffener member used in one panel of the cover of FIG. 1.
Figure 11:
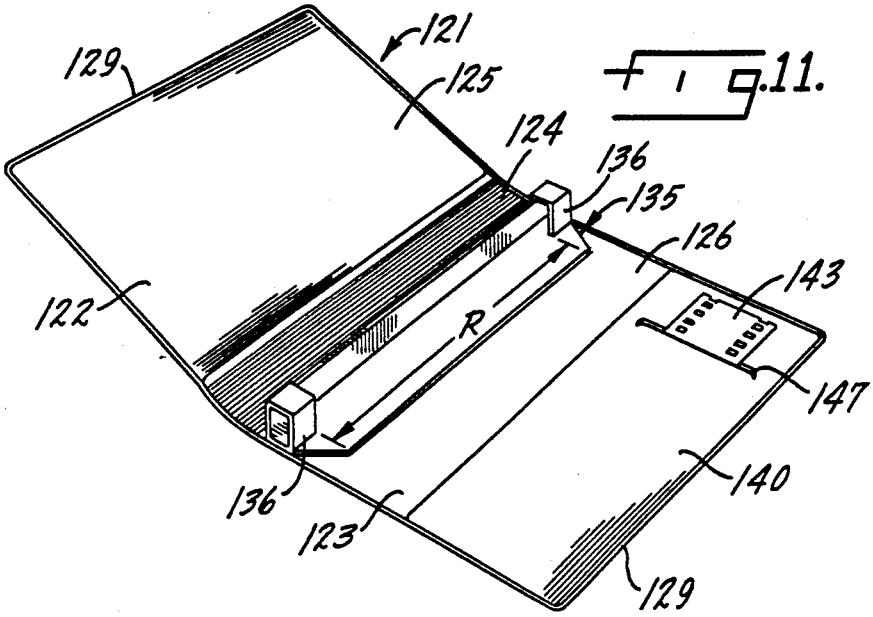
FIG. 11 is an open perspective view of a photo album assembly according to another embodiment of the invention.
Figure 12:
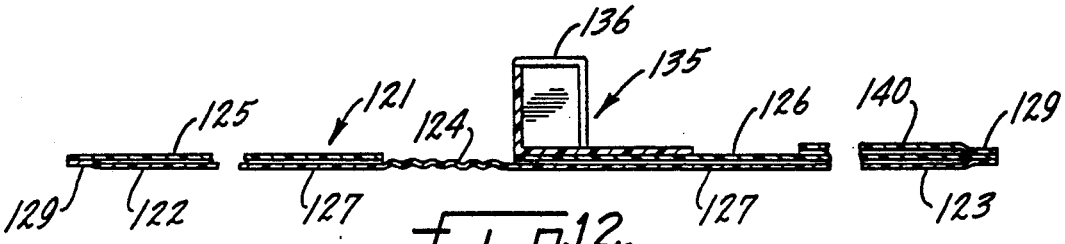
FIG. 12 is a sectional view of the assembly of FIG. 11.

FIGS. 11 and 12 illustrate a photo album assembly cover 121 constructed according to another embodiment of the invention. The book-like cover 121 includes a front cover panel 122 and a rear panel 123 each hingedly connected to a spine panel 124. Cover 121 is formed from three plastic sheets 125, 126, and 127, as shown in FIG. 2. Sheet 127 constitutes the outside of cover 121 and sheets 125 and 126 form the inner surfaces of most of the cover. Sheets 125 and 126 are made from semi-rigid sheet plastic. The rear panel inner sheets 126 has a retainer means 135 mounted on it to serve as means for retaining a plurality of photographs in the photo assembly as described above. Retainer means 135 may have the same construction as retainer means 35 (FIGS. 2–4 and 6–8), including retainers 136 at its opposite ends. The inner sheet 125 of front cover panel 122 and the inner sheet 125 of rear cover panel 123 are sealed together on three sides with sheet 127, the outside of the book-like cover 121, as indicated by seals 129 in FIGS. 11 and 12.

The book-like cover 121, FIGS. 11 and 12, further includes a small storage pocket 140 for negatives; the sheet that forms pocket 140 is sealed onto the inner plastic sheet 126 of rear panel 123. Near the top edge of pocket 140 there is an opening 147 for insertion of negatives 143 into the pocket as shown in FIG. 11.

In all embodiments of the invention, the binder members should have a length L, height H, and maximum thickness T such that $L>>H>>T$. Of course, the length L for the binder members must be somewhat larger than the spacing R between retainers 36 or 136 (see FIGS. 2 and 11) so that the binder members can be mounted on the retainers. Furthermore, each of the binder members must have slots in its opposite ends, for engaging the retainers to mount the binder member in the album cover parallel to its spine panel, and each of those slots must have a length S at least equal to one-half the difference between the dimensions L and R. The binder member should be somewhat flexible in the direction of the thickness T, to facilitate mounting between retainers 36 or 136, but must be relatively rigid in the direction of the height H to provide good mounting of the photographs in the album cover. Each hinge strip (48 or 78) should be flexible enough to allow folding so that any of the photographs can be fully exposed for thorough examination.

Figure 13:
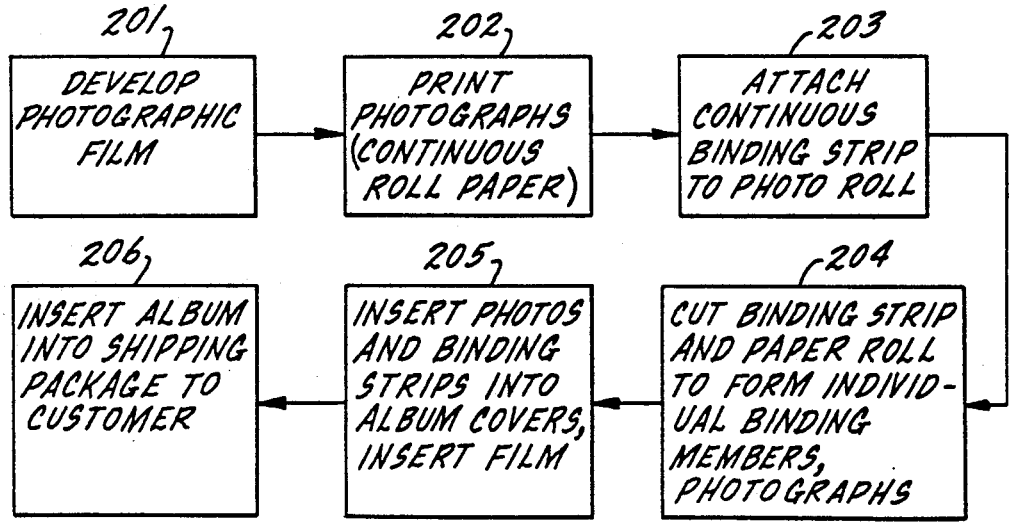
FIG. 13 is a flow chart illustrating a process for using the invention in commercial photographic processing.

The photo album assemblies of the present invention, including all of the embodiments illustrated in FIGS. 1–12 and described above, as well as the other possible variations, are particularly adapted to use in commercial photographic processing of the kind in which the individual photographer, usually an amateur, sends a roll of film in for processing and expects to receive finished photographic prints in return. FIG. 13 is a flow chart that illustrates how a commercial photographic film processing procedure may be modified to utilize the photo albums of the present invention so that a complete package, with the photos already installed in albums, is delivered to each customer.

At the outset, in step 201 of FIG. 13, the photographic film received from the customer is processed in the usual manner. The automatic equipment available in most commercial photographic processing plants for performing the development procedure of step 201 in FIG. 13 need not be modified appreciably. This also applies to the next step 202 in the procedure, in which the individual frames of the photographic film are printed out as separate photographic prints on a continuous roll of paper. At this point, however, the process must be modified if maximum efficiency in the use of the invention is to be attained.

Thus, in the next step 203 in the procedure shown in FIG. 13, a continuous binding strip is attached to the roll of printed photographs. The continuous binding strip could have the construction used for binder member 41 in FIG. 5 or could utilize the alternate construction for binder member 71 of FIGS. 9 and 10. In either event, however, the binding strip applied to the continuous roll of photographic paper in step 203 is applied to the full length of the roll of photographs; it has not been cut to individual lengths for binder members and it does not have the retainer receiving slots 42 or 72 (FIGS. 5 and 9). In the next step 204, however, the photographic prints and the elongated binding strip are cut into individual photograph lengths. The Y-shaped slots in each binding strip are cut at this time, usually using a cutter die having the requisite configuration for this purpose. Of course, a strip of the roll of photographic print paper is usually discarded from between each adjacent pair of photographs.

In the next step 205, FIG. 13, the individual photographs and binding strips are assembled into groups and inserted into the album covers. The film is also inserted into each album, as shown in FIGS. 7 and 11. All that remains to be done is to insert the album or albums into appropriate shipping packages and ship them to the customer, as in step 206. All of these steps can be performed by automated equipment, requiring only minor modifications to the equipment already serving for the processing of photographic film on a commercial basis.

I claim:

1. A photo package comprising:

a book-like cover including a front cover panel, a spine panel, and a rear cover panel, the front and rear cover panels being hinged to opposite sides of the spine panel;

a pair of retainers, mounted in the album cover adjacent opposite ends of the spine panel and immediately adjacent to one of the cover panels, with the retainers facing each other but separated by a retainer spacing R less than the height of the spine panel;

a plurality of N thin, elongated, bendable binder members each of length L, height H, and thickness T, so that $$L>>H>>T$$

with L somewhat larger than R;

each binder member having two slots, one at each end of the binder member, for engaging the two retainers to mount the binder member in the album cover parallel to the spine panel, each slot having an overall length S at least equal to one-half the difference between L and R;

and each binder member including a flexible hinge tape extending along the edge of the binder member opposite the spine panel, and an adhesive photo mounting strip, parallel to and projecting away from each hinge strip, for mounting a photo in the album; and N photographs each mounted on one of the photo mounting strips.

2. A photo package according to claim 1 in which:

each retainer is an open rectangular member formed of rigid plastic of width W, having a retainer wall facing the other retainer;

each binder member slot is Y-shaped; and the width of the leg portion of each binder member slot is larger than W so that the binder member mounts readily on the two retainers.

3. A photo package according to claim 2 in which:

the two retainer members are affixed to an angular mounting and reinforcement member; and the mounting and reinforcement member is mounted on the one cover panel.

4. A photo package according to claim 1 in which each binder member is formed as a unified, integral member including both the hinge tape and an integral photo mounting strip.

5. A photo album assembly comprising:

a book-like cover including a front cover panel, a spine panel, and a rear cover panel, the front and rear cover panels being hinged to opposite sides of the spine panel;

a pair of retainers;

means for mounting the retainers in the cover adjacent opposite ends of the spine panel and immediately adjacent to one of the cover panels, with the retainers facing each other but separated by a retainer spacing R less than the height of the spine panel;

a plurality of thin, elongated, bendable binder members each of length L, height H, and thickness T, so that $$L>>H>>T$$

with L somewhat larger than R;

each binder member having two slots, one at each end of the binder member, for engaging the two retainers to mount the binder member in the album cover parallel to the spine panel, each slot having an overall length S at least equal to one-half the difference between L and R;

N flexible hinge tapes each extending along an edge of one binder member opposite the spine panel; and N adhesive photo mounting strips, each parallel to and projecting away from one hinge tape, for mounting a photograph in the album.

6. A photo album assembly according to claim 5 in which:

each retainer is an open rectangular member formed of rigid plastic of width W, having a retainer wall facing the other retainer;

each binder member slot is Y-shaped; and the width of the leg portion of each binder member slot is larger than W so that the binder member mounts readily on the two retainers.

7. A photo album assembly according to claim 6 in which:

the two retainer members are affixed to an angular mounting and reinforcement member; and the mounting and reinforcement member is mounted on a stiffener member for the one cover panel.

8. A photo album assembly according to claim 5, in which each hinge tape is adhesively mounted on its associated binder member by means of an adhesive tape mounting strip extending longitudinally of the two.

9. A photo album assembly according to claim 8 in which the adhesive tape mounting strip is an adhesive coating on the hinge tape.

10. A photo album assembly according to claim 9 in which each adhesive strip is covered by a release film prior to use.

11. A photo album assembly according to claim 5 in which each adhesive strip is covered by a release film prior to use.

12. A photo album assembly according to claim 5 in which each binder member is formed as a unified integral member including both the hinge tape and an integral photo mounting strip.

13. A photo package according to claim 5, in which each hinge tape is adhesively mounted on its associated binder member by means of an adhesive tape mounting strip extending longitudinally of the two.

14. A photo album assembly comprising:

a book-like cover including a front cover panel, a spine panel, and a rear cover panel, the front and rear cover panels being hinged to opposite sides of the spine panel;

a pair of retainers;

means for mounting the retainers in the cover adjacent opposite ends of the spine panel and immediately adjacent to one of the cover panels, with the retainers facing each other but separated by a retainer spacing R less than the height of the spine panel;

a plurality of thin, elongated binder members each of length L, height H, and thickness T, so that $$L>>H>>T$$

with L somewhat larger than R;

each binder member having two slots, one at each end of the binder member, for engaging the two retainers to mount the binder member in the album cover parallel to the spine panel, each slot having an overall length S at least equal to one-half the difference between L and R;

and a corresponding plurality of flexible hinge tapes, one for each binder member, each hinge tape adapted to be mounted along one edge of a binder member, projecting from the binder member in a direction away from the spine panel;

each hinge tape having a flexible hinge strip, free of adhesive, that extends along and projects from the one edge of the binder member when the hinge tape is mounted thereon;

and each hinge tape further having an adhesive photo mounting strip, parallel to the hinge strip but on the opposite side of the hinge strip from the binder member, for mounting a photograph in the album.

15. A photo album assembly according to claim 14 in which:

each retainer is an open box-shaped member formed of rigid plastic of width W, having a retainer wall facing the other retainer;

each binder member slot is Y-shaped; and the width of the leg portion of each binder member slot is larger than W so that the binder member mounts readily on the two retainers.

16. A photo album assembly according to claim 15 in which:

the two retainer members are affixed to an angular mounting and reinforcement member; and the mounting and reinforcement member is mounted on a stiffener member for the one cover panel.

17. A photo album assembly according to claim 9 in which each adhesive strip is covered by a release film prior to use.

* * * * *